US006286318B1

(12) United States Patent
Maguire et al.

(10) Patent No.: US 6,286,318 B1
(45) Date of Patent: Sep. 11, 2001

(54) PULSE TUBE REFRIGERATOR AND CURRENT LEAD

(75) Inventors: James F. Maguire, Andover; Ahmed Sidi-Yekhlef; Peter M. Winn, both of Framingham, all of MA (US)

(73) Assignee: American Superconductor Corporation, Westborough, MA (US)

( * ) Notice: Subject to any disclaimer, the term of this patent is extended or adjusted under 35 U.S.C. 154(b) by 0 days.

(21) Appl. No.: 09/243,142

(22) Filed: Feb. 2, 1999

(51) Int. Cl.[7] ..... F25B 9/00
(52) U.S. Cl. ..... 62/6
(58) Field of Search ..... 62/6

(56) References Cited

U.S. PATENT DOCUMENTS

| | | | |
|---|---|---|---|
| 4,895,831 | 1/1990 | Laskaris | 505/1 |
| 5,269,147 | 12/1993 | Ishizaki et al. | 62/6 |
| 5,412,952 | 5/1995 | Ohtani et al. | 62/6 |
| 5,495,718 | 3/1996 | Pierce et al. . | |
| 5,647,218 | 7/1997 | Kuriyama et al. . | |
| 5,680,768 | 10/1997 | Ratray et al. | 62/6 |
| 5,735,127 | 4/1998 | Pfotenhauer et al. . | |
| 5,744,959 | 4/1998 | Jeker et al. | 324/319 |

FOREIGN PATENT DOCUMENTS 197 04 485 A1 8/1998 (DE) .

OTHER PUBLICATIONS

David, et al. "How to Achieve the Efficiency of a Gifford–Mac Mahon Cryocooler with a Pulse Tube Refrigerator", *Cryogenics*, 30:262–266 (1990).

*Primary Examiner*—William Doerrler
*Assistant Examiner*—Malik N. Drake
(74) *Attorney, Agent, or Firm*—Fish & Richardson, P.C.

(57) ABSTRACT

A combination refrigerator and current lead assembly includes a pulse tube having a cold end and a warm end. A first electrical connector is attached to the warm end. A second electrical connector attached to the pulse tube supplies current to a lead, for example, a high temperature superconductor lead. The assembly includes a second pulse tube having an electrical connector attached at its warm end and a second electrical connector for supplying current to a lead. The second electrical connectors are attached to the cold ends of the pulse tube. The pulse tubes are formed from an electrically conductive material. An electrical isolator electrically isolates the pulse tubes from each other. Additional electrical isolators electrically isolate the pulse tubes from a compressor, valve, and regenerators of the system.

14 Claims, 2 Drawing Sheets

PULSE TUBE REFRIGERATOR AND CURRENT LEAD

BACKGROUND OF THE INVENTION

Pulse tube refrigerating systems for producing cryogenic temperatures are known. For example, as described in Ishizaki et al., U.S. Pat. No. 5,269,147, incorporated by reference herein, a working fluid contained within a tube is compressed adiabatically by the introduction of pressurized fluid into the tube causing an increase in the temperature of the working fluid. Working fluid which has been compressed passes to a heat exchanger to transfer heat into the atmosphere. The pressurized fluid is then allowed to flow from the tube and working fluid returns to the tube and expands to decrease in temperature. The cooled working fluid passes to a refrigerating section where it is available as a coolant. The compression and expansion cycle is repeated.

SUMMARY OF THE INVENTION

A combination refrigerator and current lead assembly uses the pulse tube refrigeration system to provide cooling to a superconductor containing system as well as electrical connection between the superconductor system and a non-superconducting electrical power element. The assembly includes a pulse tube having a cold end and a warm end. A first electrical connector is attached to the warm end. A second electrical connector attached to the pulse tube supplies current to a lead.

Embodiments of this aspect of the invention may include one or more of the following features.

The lead is a high temperature superconductor lead. The second electrical connector is located at the cold end of the pulse tube. The pulse tube is formed of electrically conducting material.

According to another aspect of the invention, a combination refrigerator and current lead assembly includes two pulse tubes. Each pulse tube has a cold end and a warm end. An electrical connector is attached to the warm end of each pulse tube. A second electrical connector is attached to each pulse tube for supplying current to a lead.

Embodiments of this aspect of the invention may include one or more of the following features.

The leads are high temperature superconductor leads. The second electrical connectors are located at the cold ends of the pulse tubes. The pulse tubes are formed of electrically conducting material. An electrical isolator electrically isolates the pulse tubes from each other. A compressor delivers compressed gas to the pulse tubes. Regenerators are located in the flow path between the compressor and the pulse tubes. A valve controls the flow of gas between the compressor and the regenerators. Electrical isolators electrically isolate the pulse tubes from the regenerators, compressor and valve.

In an illustrated embodiment of the invention, a variable sized orifice is in fluid communication with the warm end of each pulse tube. A reservoir volume is in fluid communication with the orifice.

According to another aspect of the invention, a superconductor magnet assembly includes a combination refrigerator and current lead assembly and a superconductor magnet. A first high temperature superconductor lead and a second high temperature superconductor lead of the current lead assembly supply current to the superconductor magnet.

According to another aspect of the invention, a method of providing both cooling and current to leads includes providing two pulse tubes. The pulse tubes are formed from an electrically conductive material and a first electrical connector is located at a warm end of each pulse tube, and a second electrical connector is attached to each pulse tube. The first electrical connectors are used to attach each pulse tube to a power source. The second electrical connectors are used to attach each pulse tube to a respective lead, for example, a high temperature superconductor lead.

Advantages of the invention include an efficient method of providing current to a high temperature superconductor lead while simultaneously cooling the high temperature superconductor lead.

BRIEF DESCRIPTION OF THE DRAWINGS

Other objects, features and advantages of the invention will be apparent from the following description taken together with the drawings in which.

DESCRIPTION OF THE PREFERRED EMBODIMENT

Figure 1:
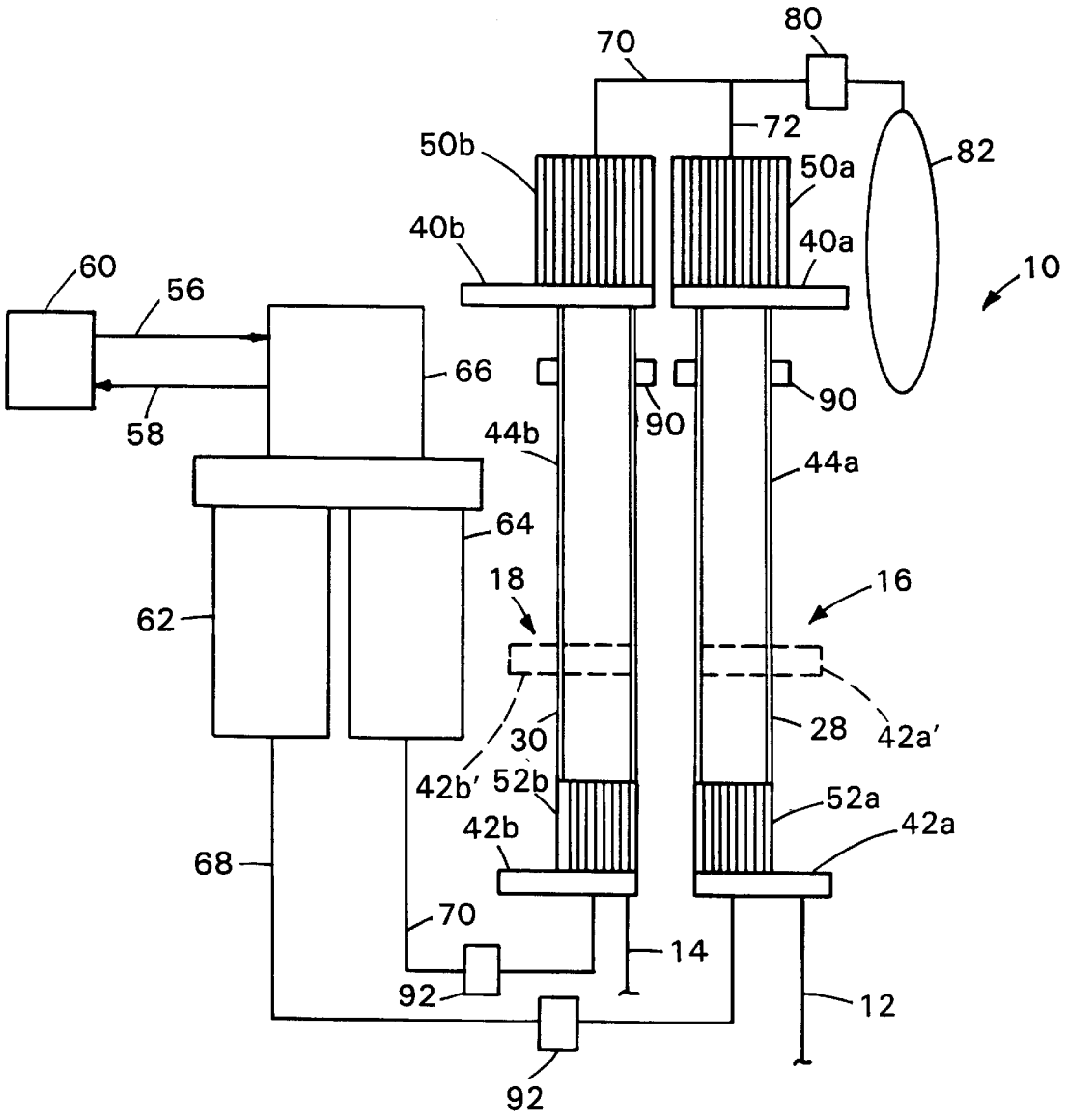
FIG. 1 is a diagrammatic representation of a combination refrigerator and current lead assembly of the invention.

Referring to FIG. 1, a combination refrigerator and current lead assembly 10 for supplying current to leads 12, 14, for example, high temperature superconductor leads of a superconductor magnet, includes two pulse tube refrigerators 16 and 18. In addition to acting as refrigerators, pulse tube 16 includes a positive current lead 28, and pulse tube 18 includes a negative current lead 30.

Current leads 28, 30 each include a warm end electrical lug 40*a*, 40*b* and a cold end electrical lug 42*a*, 42*b*, respectively. Lugs 40*a* and 42*a*, and lugs 40*b* and 42*b* are connected by an electrically conductive tube 44*a*, 44*b*, respectively. Tubes 44*a*, 44*b* are typically formed from copper or brass. Brass is preferable because a brass tube can be shorter than a copper tube while creating the same heat load as the copper tube. The shorter tube provides a more compact design. For example, for a 100 amp lead, a copper lead would have a length to area ratio of about 470 cm/cm2 and a brass lead with the same heat load (about 5 watts) would have a ratio of about 80 cm/cm2. For the same cross section of tube, the copper lead would need to be almost six times longer than the brass lead. This is due to copper's higher thermal conductivity. Lugs 40*a*, 40*b*, 42*a*, 42*b* are typically formed from copper.

The operation of pulse tube refrigerator systems is described for example in Ishizaki et al, supra, and Ohtani et al, U.S. Pat. No. 5,412,952, incorporated by reference herein. Briefly and with reference to FIG. 1, the flow of high pressure room temperature, helium gas at, for example, 18 atm, between a compressor 60 and a pair of regenerators 62, 64 is controlled by a periodic valve 66. The gas pressure is selected based upon desired system efficiency. Gas flows from compressor 60 to valve 66 through an inlet line 56, and from valve 66 to compressor 60 through an outlet lines 58. Pulses of gas delivered to regenerators 62, 64 travel through gas lines 68, 70 and enter pulse tubes 16, 18, respectively, at a temperature of about 60 K. Gas within tubes 44*a*, 44*b* of pulse tubes 16, 18 is compressed, followed by expansion when periodic valve 66 is actuated to allow reverse flow. The expansion of the gas within pulse tubes 16, 18 causes the gas to cool to about 4 K.

Pulse tubes 16, 18 include a warm end heat exchanger 50*a*, 50*b* and a cold end heat exchanger 52*a*, 52*b*, respectively. Attached to warm end heat exchanger 50*a,* 50*b* of each pulse tube 16, 18 by flow lines 72, 70 is an orifice 80 and reservoir 82, for example, one, two or three reservoirs each with an active orifice valve. The size of orifice 80 can be adjusted to tune pulse tubes 16, 18, as discussed, for example, in Ohtani et al, supra.

Pulse tubes 16, 18 are electrically isolated from each other by electrical isolators 90, and pulse tubes 16, 18 are electrically isolated from regenerators 62, 64, valve 66, and compressor 60 by electrical isolators 92. Electrical isolators 92, are, for example, helium leak-tight ceramic electrical isolators available from Ceramaseal, New Lebanon, N.Y.

Figure 2:
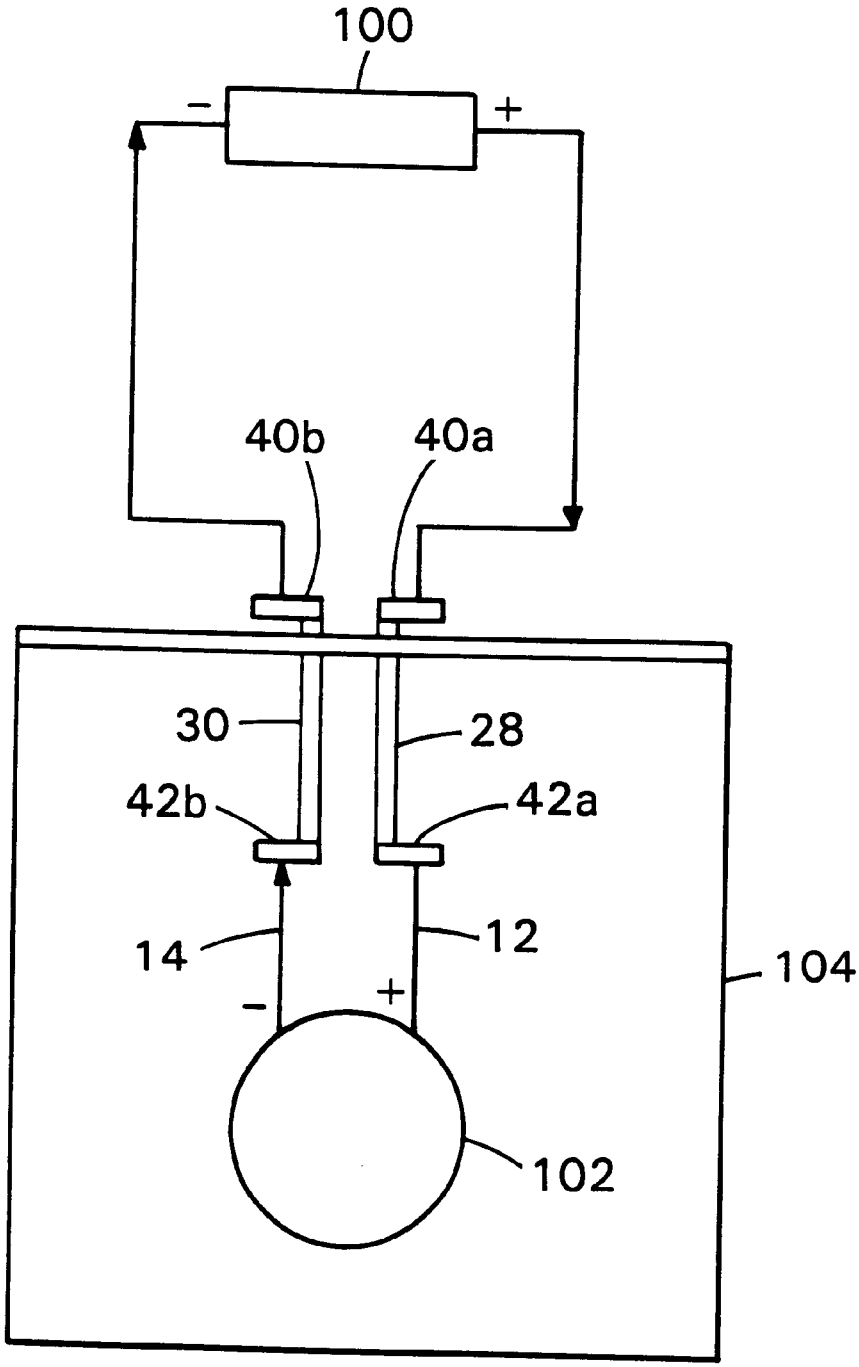
FIG. 2 is an electrical schematic of the combination refrigerator and current lead assembly of FIG. 1, shown supplying current to a superconductor magnet.

Referring to FIG. 2, positive current lead 28 is connected to high temperature superconductor lead 12 by its cold end lug 42*a,* and to a power supply 100 by its warm end lug 40*a.* Negative current lead 30 is connected to high temperature superconductor lead 14 by its cold end lug 42*b,* and to power supply 100 by its warm end lug 40*b.* Leads 12, 14 supply current to any electrical device requiring cooling, for example, a superconductor magnet 102, transformers, motors, power cables, and RF cavities.

Magnet 102 has a working temperature in the range of, for example, about 10–40 K. High temperature superconductor leads 12, 14 have a working temperature in the range of, for example, about 20–40 K. Lugs 42*a,* 42*b* are maintained at a temperature in the range of, for example about 50–90 K, and lugs 40*a,* 40*b* are at room temperature. Magnet 102, leads 12, 14 and the majority of leads 28, 30 are housed within a vacuum chamber 104, for example, a liquid nitrogen cooled vacuum chamber. Heat generated in high temperature current leads 12, 14 is absorbed at cold end heat exchangers 52*a,* 52*b,* and expelled at warm end heat exchangers 50*a,* 50*b.*

The cooling of the gas within pulse tubes 16, 18 creates a temperature gradient along the length of the pulse tubes. Referring again to FIG. 1, cold lugs 42*a,* 42*b* can be positioned at any height along pulse tubes 16, 18 (cold lugs 42*a'*, 42*b'*shown in dashed lines). This may be desirable, for example, where superconductor magnet 102 has a large heat load relative to high temperature superconductor leads 12, 14, and cold end heat exchangers 52*a,* 52*b* are brought to a lower temperature to supply the required cooling to superconducting magnet 102. The desired cold lug temperature is a higher temperature than the magnet cooling temperature and thus corresponds to a position higher on the pulse tubes. Cold end heat exchangers 52*a,* 52*b* would be thermally anchored to the magnet with straps (not shown).

Other embodiments are within the scope of the following claims.

What is claimed is:

1. A combination refrigerator and current lead assembly, comprising:

a first pulse tube having a cold end and a warm end, a first electrical connector attached to the warm end of the first pulse tube, and a second electrical connector attached to the first pulse tube for supplying current to a first lead, and a second pulse tube having a cold end and a warm end, a third electrical connector attached to the warm end of the second pulse tube, and a fourth electrical connector attached to the second pulse tube for supplying current to a lead.

2. The assembly of claim 1 wherein the first lead comprises a high temperature superconductor lead and the second lead comprises a high temperature superconductor lead.

3. The assembly of claim 1 wherein the second electrical connector is located at the cold end of the first pulse tube, and the fourth electrical connector is located at the cold end of the second pulse tube.

4. The assembly of claim 1 wherein the first and second pulse tubes are formed of electrically conducting material.

5. The assembly of claim 4 further comprising an electrical insulator for electrically insulating the first and second pulse tubes from each other.

6. The assembly of claim 1 further comprising a compressor for delivering compressed gas to the first and second pulse tubes.

7. The assembly of claim 6 further comprising a first regenerator and a second regenerator located in a flow path between the compressor and the first and second pulse tubes.

8. The assembly of claim 7 further comprising a valve for controlling the flow of gas between the compressor and the first and second regenerators.

9. The assembly of claim 8 further comprising electrical isolators for electrically isolating the first and second pulse tubes from the first and second regenerators, the compressor and the valve.

10. The assembly of claim 1 further comprising a variable sized orifice in fluid communication with the warm end of each pulse tube.

11. The assembly of claim 10 further comprising a reservoir volume in fluid communication with the orifice.

12. A superconductor magnet assembly, comprising:

a combination refrigerator and current lead assembly, including a first pulse tube having a cold end and a warm end, a first electrical connector attached to the warm end of the first pulse tube, and a second electrical connector attached to the first pulse tube for supplying current to a first high temperature superconductor lead, and a second pulse tube having a cold end and a warm end, a third electrical connector attached to the warm end of the second pulse tube, and a fourth electrical connector attached to the second pulse tube for supplying current to a second high temperature superconductor lead, and a superconductor magnet, the first high temperature superconductor lead and the second high temperature superconductor lead supplying current to the superconductor magnet.

13. A method of providing cooling and current to leads, comprising:

providing first and second pulse tubes, each pulse tube being formed of an electrically conductive material, a first electrical connector being attached at a warm end of each pulse tube, and a second electrical connector being attached to each pulse tube, attaching the first electrical connector of each pulse tube to a power source, and attaching the second electrical connector of each pulse tube to a respective lead.

14. The method of claim 13 the respective lead comprises a high temperature superconductor lead.

* * * * *